US007837177B2

(12) United States Patent
McNeill

(10) Patent No.: US 7,837,177 B2
(45) Date of Patent: Nov. 23, 2010

(54) POST HANDLING ASSEMBLY

(75) Inventor: Peter John McNeill, 3 MacMaster Parade, MacMasters Beach, New South Wales (AU) 2251

(73) Assignee: Peter John McNeill, Macmasters Beach (AU)

( * ) Notice: Subject to any disclaimer, the term of this patent is extended or adjusted under 35 U.S.C. 154(b) by 0 days.

(21) Appl. No.: 11/990,842

(22) PCT Filed: Aug. 22, 2006

(86) PCT No.: PCT/AU2006/001216

§ 371 (c)(1),
(2), (4) Date: Feb. 25, 2009

(87) PCT Pub. No.: WO2007/022577

PCT Pub. Date: Mar. 1, 2007

(65) Prior Publication Data

US 2009/0178818 A1 Jul. 16, 2009

(30) Foreign Application Priority Data

Aug. 25, 2005 (AU) ..... 2005904624

(51) Int. Cl.
*E21B 19/00* (2006.01)

(52) U.S. Cl. ..... 254/30; 254/131

(58) Field of Classification Search ..... 254/30, 254/133 R, 131, 29 R
See application file for complete search history.

(56) References Cited

U.S. PATENT DOCUMENTS

| | | | | |
|---|---|---|---|---|
| 4,040,601 | A * | 8/1977 | Boardman | 254/133 R |
| 5,205,541 | A * | 4/1993 | Roberts et al. | 254/131 |
| 5,368,277 | A * | 11/1994 | Moss | 254/30 |
| 7,059,587 | B1 * | 6/2006 | Fimple | 254/30 |
| 2009/0178818 | A1 * | 7/2009 | McNeill | 173/90 |

FOREIGN PATENT DOCUMENTS

NZ 517509 8/2004

OTHER PUBLICATIONS

Notification Concerning Transmittal of International Preliminary Report on Patentability mailed Mar. 6, 2008 in International Appln. No. PCT/AU2006/001216.

* cited by examiner

*Primary Examiner*—Lee D Wilson
(74) *Attorney, Agent, or Firm*—Davidson Berquist Jackson & Gowdey LLP

(57) ABSTRACT

According to one aspect of the present invention there is provided a manually operated post handling assembly including a main body, a post driver that is integral with or connected to the main body and a post extractor being adapted to move between a deployed position and a stowed position within the main body.

19 Claims, 4 Drawing Sheets

POST HANDLING ASSEMBLY

This application is the national stage of International Application No. PCT/AU2006/001216, with an international filing date of Aug. 22, 2006, which claims priority to Australian Application No. 2005904624, filed Aug. 25, 2005.

FIELD OF THE INVENTION

The present invention relates generally to handling posts such as for example fence posts, star pickets, silt fence posts and the like. It is generally required that these posts should be installed in the ground and withdrawn from the ground from time to time, and installed in other places. The present invention facilitates these post driving and removing operations.

BACKGROUND OF THE INVENTION

It is known to install posts with a post ram or drive, which is manually actuated. The post ram includes a drive head disposed within an alignment tube, and handles for ease of grip.

Usually, a separate second device is used to extract the post from the ground, which is heavy, expensive, and takes up extra room on a worker's truck.

The present invention seeks to ameliorate one or more of the abovementioned disadvantages.

SUMMARY OF THE INVENTION

According to one aspect of the present invention there is provided a manually operated post handling assembly including: a main body; a post drive means integral with or connected to the main body; and a post extraction means including a post grip assembly operatively connected to the main body, the post extraction means being adapted to move between a deployed position and a stowed position.

Preferably the main body includes a retaining portion an/or a housing in the form of a stowing chamber so as to stow the post extraction means. Preferably the stowing chamber is a hollow within the main body. Preferably the stowed position is adjacent to or internal to the main body and the post extraction means is adapted to be detached or disassembled from the main body and stowed within the stowing chamber. However, in one preferred embodiment the post extraction means is adapted to retract into the housing or stowing chamber.

Preferably the main body is an elongate body which includes a longitudinal axis. In one form the drive means is disposed within the main body and the drive means includes a drive head for engaging with and striking a post head when the post is in a stand-by drive position.

Preferably the drive means includes an alignment means for engaging with a post shaft so as to increase the likelihood of the post drive head striking the post head along the longitudinal axis. In one form the alignment means is a hollow tube.

In one embodiment the drive head is a blind end of the hollow tube, which may be a plate welded across the internal section of the tube.

Preferably, handles are provided for improving the grip of an operator on the main body. In one form, the handles are grip posts which extend substantially along the length of the main body, spaced a selected distance from the longitudinal axis of the main body. Preferably, spacing elements are provided to space the grip posts from the main body, extending from the main body to form shoulders, disposed at opposite sides of the main body.

Preferably the stowage chamber is disposed within the main body, commencing at one end adjacent the drive head. A preferred embodiment is arranged such that the drive head is disposed at an intermediate position within the main body tube which in effect divides the main body tube into two chambers—an aligning chamber and the stowage chamber.

Preferably the post grip assembly includes a post grip element which includes post engaging walls spaced across a post receiving aperture. In one form the aperture is a bight or fixed jaw, the post grip element being in one preferred embodiment, in the general shape of the head of a C-spanner. Preferably pads such as for example pads constructed from hardened steel or cast iron are provided to improve wear and or grip of the walls. These pads may be of varying sizes to further accommodate various sizes of post.

Preferably the post grip assembly includes a stem for supporting the post grip element. The stem spaces the post grip element so that the shoulders do not interfere with the post when being removed.

Preferably a pivot is provided to pivot the post grip assembly about a base of the stem, so as to facilitate stowing and positioning on the post into the deployed position.

Preferably an elongate aperture is provided to slide the pivot into the stowed position and into the deployed position. The elongate aperture is provided in side walls of the stowage chamber. The arrangement is such that the pivot is in an outer end of the elongate aperture when the grip element is in the deployed position, and the pivot is in an inner end of the elongate aperture when the grip element is in the stowed position.

Preferably, shoulder reinforcement means are provided to provide a broader platform for the shoulders, which become a fulcrum when removing the posts from the ground. This alleviates the shoulders from digging into the ground when extracting the posts.

Preferably, a keeping means is provided to keep the post extraction means in the stowage chamber. In one form the keeping means is at least one post which extends into the stowage chamber. Preferably, at least one pair of posts is provided, spaced apart to receive one or more lugs mounted on the stem in an interference fit. Preferably the posts are rubber posts integral with a rubber boot, the posts extending through holes in the side of the main body.

DESCRIPTION OF A PREFERRED EMBODIMENT

In order to enable a clearer understanding of the present invention, a preferred embodiment will hereinafter be described with reference to the attached drawings, and in those drawings.

Figure 1:
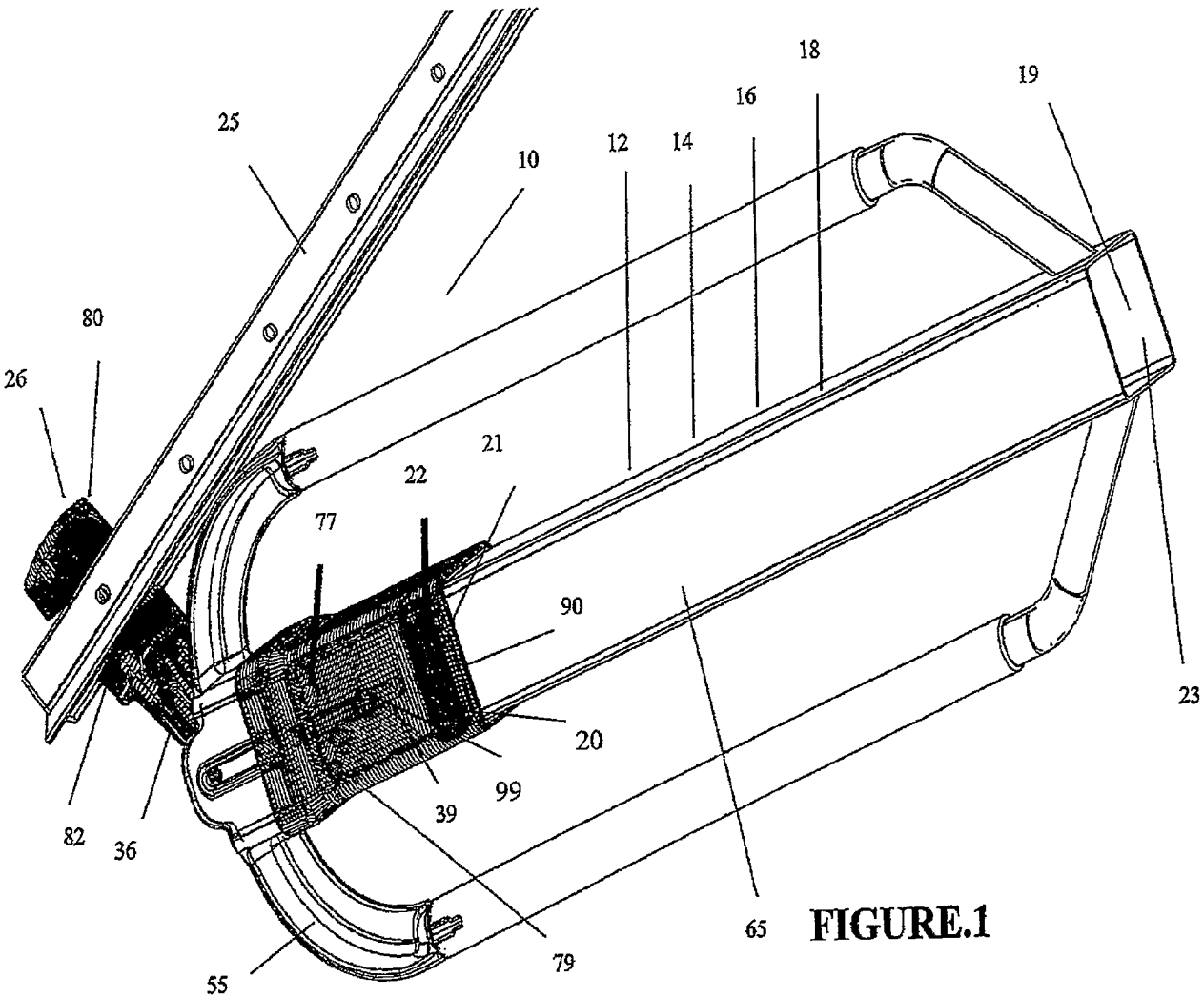
FIG. 1 is an isometric view of a post handling device showing a retractable post extraction means in an extraction position.
Figure 2:
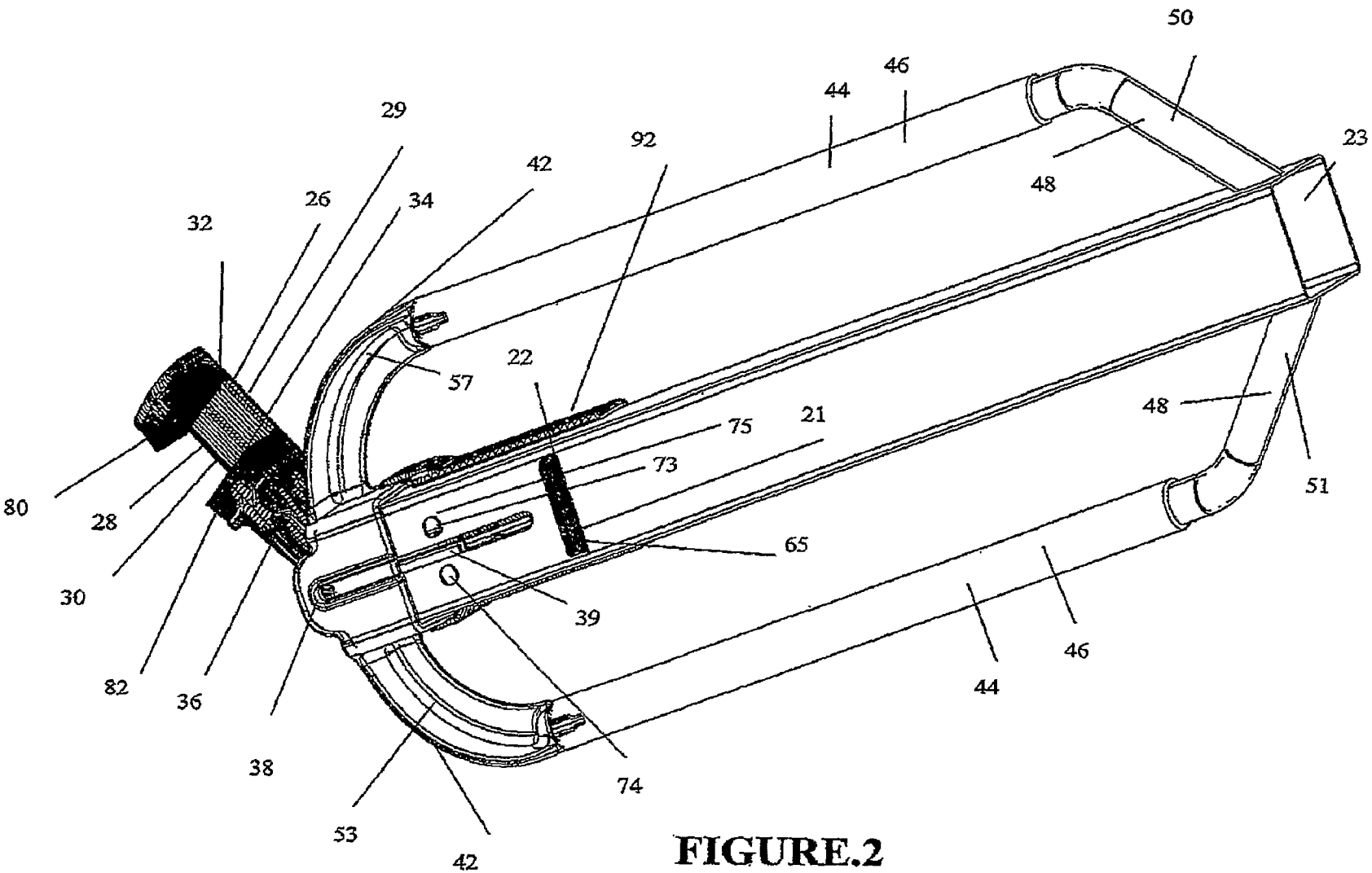
FIG. 2 is a view of the post handling device similar to the view shown in FIG. 1, with a rubber boot and post removed for clarity.
Figure 3:
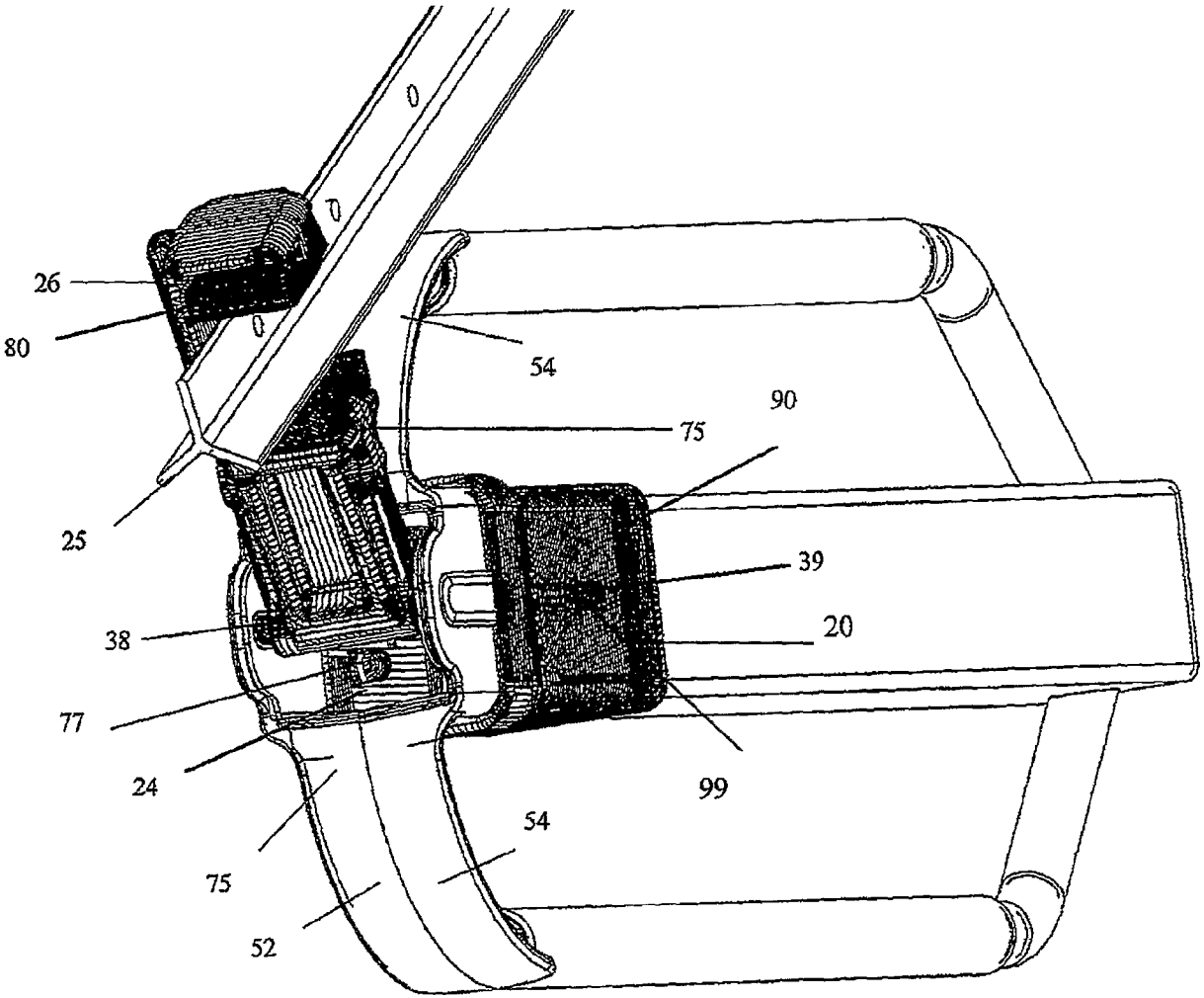
FIG. 3 is an isometric view of the post handling assembly in the extraction position, showing the stowing chamber with keepers for stowing the post extraction means.
Figure 4:
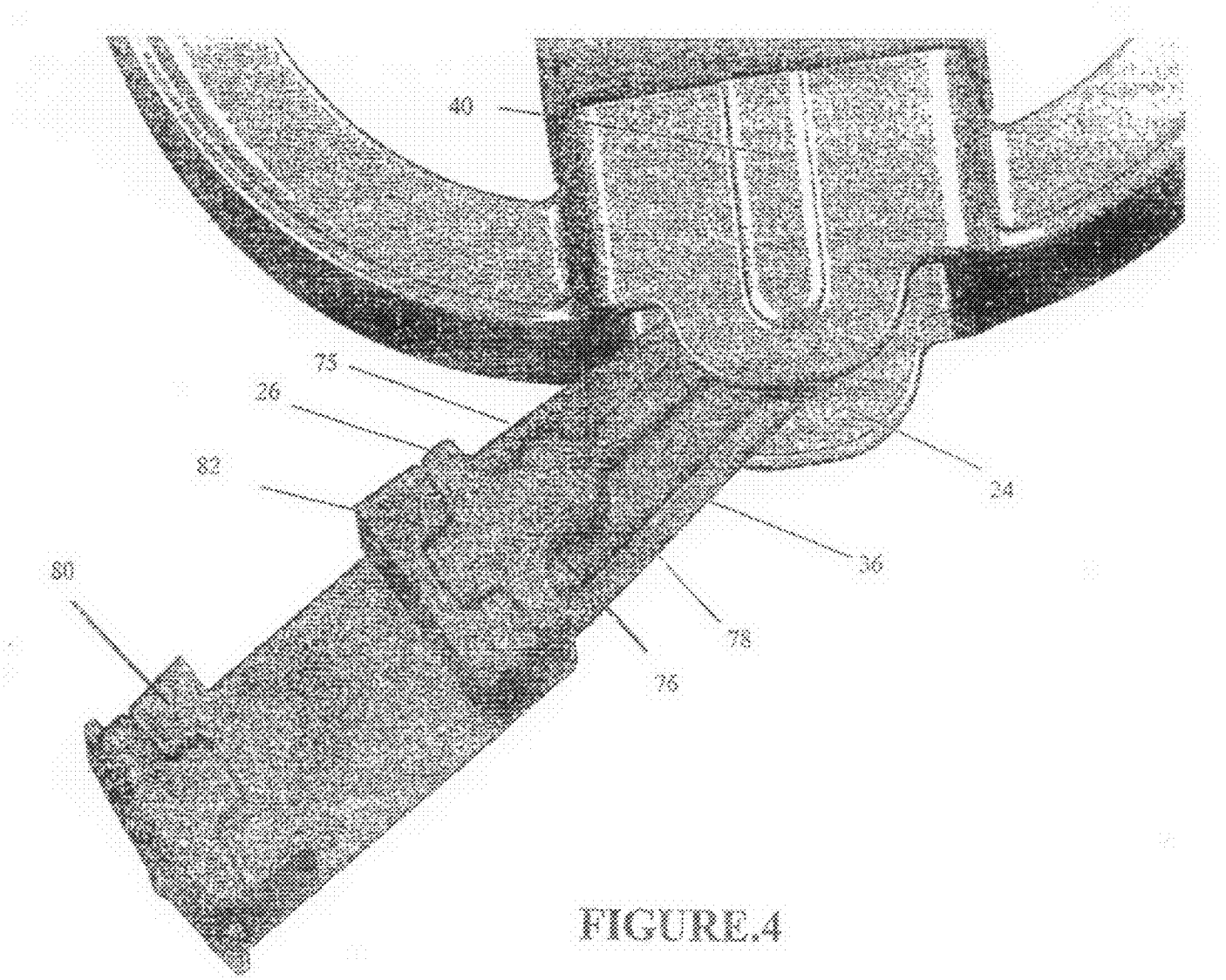
FIG. 4 is a detail view of the post extraction means showing lugs and detent wells for keeping the post extraction means in the stowing chamber.

Referring to the drawings, there is shown a preferred embodiment of post handling device generally indicated at 10. The post handling device 10 includes a main body 12 in the form of an elongate body 14 being in the form of a hollow tube 16. An alignment means 18 is provided which also is in the form of elongate body 14 in the form of hollow tube 16.

The alignment means 18 includes a peripheral internal wall 19 which engages with a post shaft 25 to facilitate alignment of drive assembly 65 including drive head 20, relative to the post 25, as well as align the post 25 with a selected orientation relative to the ground (generally perpendicular).

The drive head 20 is in the form of a wall 21 at a blind end 22 of the tube 16. The blind wall 21 is in the form of a plate (not shown) welded across the interior section of the tube 16. In driving operation, post 25 is loaded into the tube 16 via opening 23. The assembly is then repeatedly lifted up and down so that drive head 20 repeatedly strikes the post head, forcing the post into the ground.

The main body 12 extends past the blind wall 21 to provide a retaining means in the form of a stowage chamber 24, for stowage of a post extraction assembly 26. The post extraction assembly 26 includes a post grip head 29 including a post receiving aperture 28 in the form of a jaw or post receiving blight 30, having opposed grip edges 32, 34. The post grip head 29 is mounted on a post grip stem 36, which is in turn mounted on a pivot 38, itself mounted in elongate apertures 39, 40.

To assemble the device 10, the post extractor stem 36 is inserted into the stowage chamber 24. At that stage, rubber boots 90, 92 may or may not be present on the tube 16. The axle or pivot 38 is then pressed into the stem 36 through the elongate aperture 39 and centrally located by a grub screw. An axle door or window 99 is provided in the boots 90, 92 through which the axle may be pushed to press the axle 38 into the stem 36. The axle or pivot 38 is slightly longer than the tube 16 is wide, so that the axle 38 prevents the whole stem 36 from bodily falling out of the stowage chamber 24. The boots 90, 92, if they have not been affixed, may then be affixed, pressing the keeping means which include posts 77, 79 into apertures 73 and 74. The keeping means is described below.

The elongate aperture 39, 40 facilitates deployment and stowing of the post extraction assembly 26 by allowing the pivot 38 to slide between ends of the apertures 39, 40. Once out of the stowage chamber 24, the post grip stem 36 pivots so as to position the post grip head 29 outside shoulders 42 for obstacle-free engagement with a post in the ground. Steel pads 80, 82, possibly hardened, are provided to improve bite and wear of the post grip head JAW.

Handles 44 are provided which are in the form of grip posts 46 which are parallel to and spaced from main body 12. The grip posts 46 are connected by spacing tubes 48 which extend from the main body to form shoulders 50, 51, 53, 57. Shoulder-broadeners 52 are provided in the form of contoured plates 54 which facilitate the forming of a broad footing for a fulcrum 55 when extracting a post from the ground.

In operation, the post is driven into the ground in the known manner—by striking wall 21 against the post head. The post extraction assembly 26 is generally held in the stowage chamber for this application by keeping means 75 in the form of posts 77 and 79 which are integral with boot 90 and 92 and which are spaced to provide an interference fit with detent lugs 78. A detent well 76 is provided in which the posts 77 and 79 reside when the stem 36 is in the stowage chamber 24.

For extraction, the device 10 is inverted and the post extraction assembly 26 is removed from the stowage chamber 24. The pivot 38 allows ambidextrous extraction. The post is inserted in bight 30 and the device is operated by tilting the main body 12 about fulcrum 55. The stem 36 tilts to effectively tighten or close aperture 28 and grip the shaft with edges 32, 34. Mechanical advantage is gained by the lever arm 12 (length of main body) compared with stub 62 (distance from fulcrum 55 to bight 30). The grip edges 32, 34 bite into the post, so that friction is increased for extraction. As will be appreciated, the extraction process is taken in short bites. The pivot 38 facilitates the release of the post after one step and a quick re-positioning of the bight 30 on the shaft of the post for further extraction steps.

The post extraction assembly 36 may take a suitable form and may be removable for storage elsewhere on, in or in another location entirely, separate from the device 10.

Finally, it is to be understood that various alterations, modifications and/or additions may be incorporated into the various constructions and arrangements of parts without departing from the spirit or ambit of the invention.

The invention claimed is:

1. A manually operated post handling assembly including: a main body; a post driver integral with or connected to the main body; and a post extractor including a post grip assembly operatively connected to the main body, wherein a stowage chamber is provided in the form of a hollow within the main body in which to stow the post extractor and the post extractor is adapted to move between a deployed position extending from the hollow and the stowed position within the hollow.

2. The manually operated post handling assembly in accordance with claim 1 wherein the post extractor is adapted to be detached or disassembled from the main body and stowed within the stowage chamber.

3. The manually operated post handling assembly in accordance with claim 1 wherein the post extractor is adapted to retract into the housing or stowage chamber.

4. The manually operated post handling assembly in accordance with claim 1 wherein the post driver is disposed within the main body and the post driver includes a drive head for engaging with and striking a post head when the post is in a stand-by drive position.

5. The manually operated post handling assembly in accordance with claim 4 wherein the stowage chamber is disposed within the main body, commencing at one end adjacent the drive head.

6. The manually operated post handling assembly in accordance with claim 1 wherein the post driver includes a drive head that is in the form of a blind end of an alignment means in the form of a hollow tube, the drive head being a plate welded across the internal section of the tube.

7. The manually operated post handling assembly in accordance with claim 1 wherein handles are provided for improving grip of an operator on the main body, the handles being in the form of grips posts which extend substantially along the length of the main body, spaced a selected distance from a longitudinal axis of the main body.

8. The manually operated post handling assembly in accordance with claim 7 wherein spacing elements are provided to space the grip posts from the main body, extending from the main body to form shoulders, disposed at opposite sides of the main body.

9. The manually operated post handling assembly in accordance with claim 1 wherein the post grip assembly includes a post grip element which includes a post receiving aperture including spaced-apart post engaging walls.

10. The manually operated post handling assembly in accordance with claim 9 wherein the post receiving aperture is a bight, the post grip element being in the general shape of the head of a C-spanner.

11. The manually operated post handling assembly in accordance with claim 9 wherein steel pads are provided, mounted on the spaced-apart walls to improve wear of the post grip element.

12. The manually operated post handling assembly in accordance with claim 1 wherein the post grip assembly includes a stem for supporting the post grip element, the stem spacing the post grip element from the main body so that the main body does not interfere with the post when being removed.

13. The manually operated post handling assembly in accordance with claim 12 wherein a pivot or axle is provided to pivot the post grip assembly about a base of the stem, so as to facilitate stowing and deploying deployed by retraction or extension.

14. The manually operated post handling assembly in accordance with claim 13 wherein an elongate aperture is provided to slide the pivot into the stowed position and into the deployed position, the elongate aperture being disposed parallel to the main body and stowage chamber, the pivot being disposed in an outer end of the elongate aperture when the grip element is in the deployed position, and the pivot being in an inner end of the elongate aperture when the grip element is in the stowed position.

15. The manually operated post handling assembly in accordance with claim 1 wherein shoulder reinforcement means are provided to provide a broader platform for the shoulders, which become a fulcrum when removing the posts from the ground, so as to inhibit the shoulders digging into the ground when extracting the posts.

16. The manually operated post handling assembly in accordance with claim 1 wherein a keeping means is provided to keep the post extraction means in the stowage chamber.

17. The manually operated post handling assembly in accordance with claim 16 wherein the keeping means is at least one post which extends into the stowage chamber.

18. The manually operated post handling assembly in accordance with claim 17 wherein at least one pair of posts is provided, spaced apart to receive one or more lugs mounted on the stem in an interference fit.

19. The manually operated post handling assembly in accordance with claim 18 wherein the posts are rubber posts integral with a rubber boot, the posts extending through holes in the side of the main body.

* * * * *